United States Patent [19]

Reinhart et al.

[11] Patent Number: 4,691,080

[45] Date of Patent: Sep. 1, 1987

[54] HERMETICALLY SEALED CONNECTOR DEVICE

[75] Inventors: Charles W. Reinhart, Glendale; Robert H. Mauldin, Flintridge, both of Calif.

[73] Assignee: Whittaker Corporation, Los Angeles, Calif.

[21] Appl. No.: 789,602

[22] Filed: Oct. 21, 1985

[51] Int. Cl.[4] ..... H01R 4/02

[52] U.S. Cl. ..... 174/88 R; 439/271

[58] Field of Search ..... 174/88 R; 339/94 A, 339/104, 105, 138, 139 C

[56] References Cited

U.S. PATENT DOCUMENTS 4,441,777 4/1984 Harootion ..... 339/138 X 4,504,695 3/1985 Fontaine et al. ..... 174/88 R X

*Primary Examiner*—Eugene F. Desmond

*Attorney, Agent, or Firm*—Donald E. Nist

[57] ABSTRACT

The connector device comprises a male plug of stainless steel or the like having a housing containing a number of spaced passageways within which wire-bearing electrical conduits are hermetically secured. The device also includes a female receptacle of stainless steel or the like having an annular rim defining a central space within which the front end of the male plug is hermetically sealed. The female receptacle has a central passageway within which a multi-wire electrical conduit is hermetically secured. A dielectric wire spreader of polytetrafluoroethylene or the like is disposed in the central space with a frusto-conical front thereof abutting a dielectric spacer positioned against the conduit sealed in the female receptacle central passageway and with the rear end thereof abutting the front of the male plug. Passageways in the spacer and male plug rear end conduct conduit wires to the spreader where they are disposed in parallel surface grooves and interconnected. The device is simple, inexpensive and efficient.

10 Claims, 2 Drawing Figures

HERMETICALLY SEALED CONNECTOR DEVICE

BACKGROUND OF THE INVENTION

1. Field of the Invention

The present invention generally relates to electrical devices and more particularly to a novel hermetically sealed electrical conduit connector.

2. Prior Art

Conduit connectors for various speciality applications, such as nuclear reactors and high frequency electronic components, frequently are required to afford protection of the conduits against heat, corrosive gases and liquids, moisture and the like. However, such connectors normally are not properly designed to provide such protection over any reasonable length of time. Those connectors which employ male and female components also are frequently difficult to properly align and to attach to the conduit ends so that much time is wasted in installing, replacing and repairing such connectors. In many applications repeated movement of the connectors, for example when used in vibrating vehicles and the like, results in loosening of the connector components, thereby permitting breach of the thermal and corrosion seals and eventually impairing the electrical connection provided by the connector. In many instances, there is a need to join wiring from a plurality of electrical conduits to wiring from a single conduit and hermetically protect the joined wiring. Conventional connectors for such purposes are complicated, expensive and inefficient.

There is therefore currently a need for a simple, relatively inexpensive, highly efficient electrical conduit connector which hermetically seals multiple conduit ends and connector components against corrosion, heat and other adverse conditions and which provides a margin of safety against loosening of the components thereof by vibration during use. Such a connector should be easily welded or otherwise installed on stainless steel jacketed coaxial cables and the like. It should be adaptable for use in nuclear reactors and in high frequency microwave applications.

SUMMARY OF THE INVENTION

The improved weatherproof hermetically sealed multiple conduit-to-single conduit connector device of the present invention satisfies all of the foregoing needs. The connector device is substantially as set forth in the Abstract above. Thus, it comprises a male plug having a housing defining a number of conduit-receiving passageways and a female receptacle having a central passageway for receiving a single conduit carrying a plurality of wires. The female receptacle has a terminal rim defining a central space in which the male plug is hermetically sealed.

A dieletric wire spreader is disposed in front of the male plug in the central space and has a front tapered end bearing spaced wire-receiving grooves and abutting a dielectric spacer positioned against the central passageway in the central space. That spacer and the rear end of the wire spreader have wire-receiving passageways for conducting wires from multiple conduits positionable in the male plug and from a single conduit positionable in the female receptacle central passageway to the wire spreader for interconnection in the hermetically sealed central space. The connector device is inexpensive, easy to assemble and use and affords effective protection to the conduic wires against loosening, corrosion and electrical failure. Further features of the improved connector device are set forth in the following detailed description and accompanying drawings.

DRAWINGS

FIG. 1 is a schematic side elevation, partly in cross-section and partly broken away, of a preferred embodiment of the improved connector device of the present invention, showing the device hermetically sealed together with a plurality of two wire conduits secured therein; and, FIG. 2 is a vertical cross-section of the device of FIG. 1, taken along the section line 2—2 of FIG. 1.

DETAILED DESCRIPTION

Figure 1:
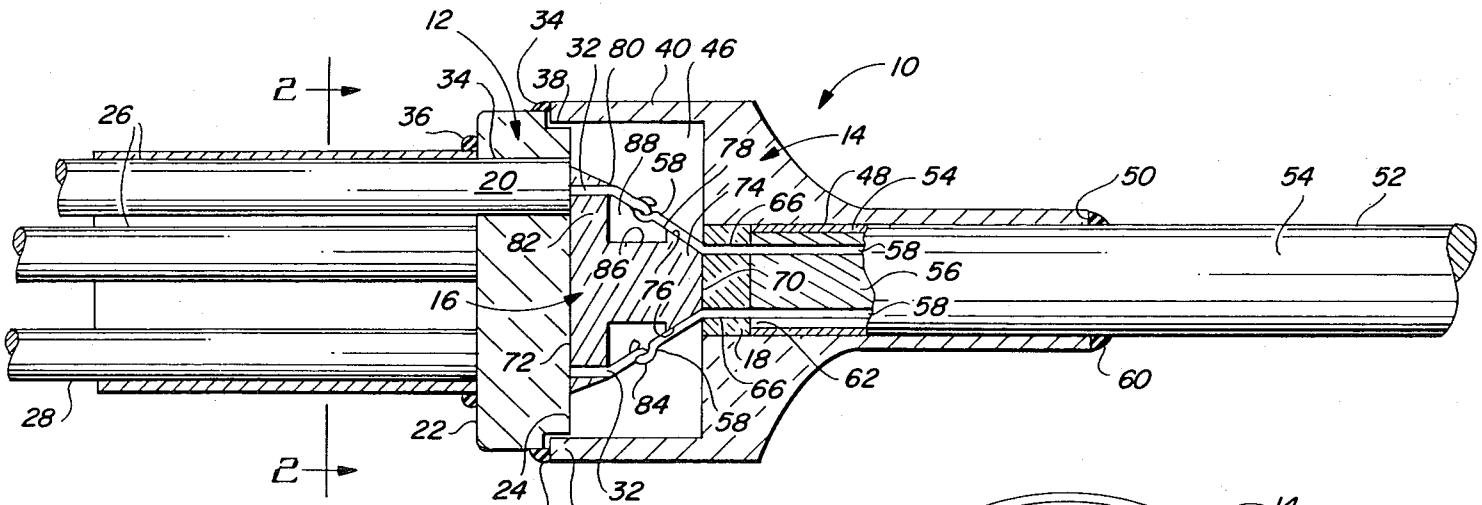

Now referring more particularly to FIG. 1 of the accompanying drawings, a preferred embodiment of the improved hermetically sealed multiple conduit-to-single conduit connector device of the present invention is schematically depicted therein. Thus, device 10 is shown which comprises a male plug 12, a female receptacle 14, a dielectric wire spreader 16 and optionally a dielectric spacer 18.

Figure 2:
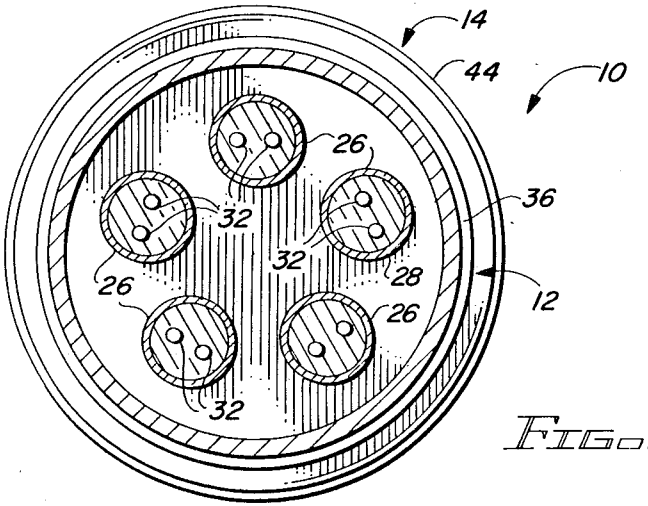

Male plug 12 is preferably generally cylindrical and of corrosion resistant metal, such as stainless steel or the like. It defines a plurality of spaced parallel passageways 20 extending therethrough from the rear end 22 thereof to the front end 24 thereof. As shown in FIG. 2, in this instance plug 12 has five passageways 20 within which conduits 26 are secured.

Each conduit 26 may comprise a metallic sheath 28 and a dielectric core 30 bearing, for example, a pair of spaced electrically conductive wires 32. The sheath 28 is stripped from the front portion 34 of each conduit 26 (FIG. 1) and portion 34 is positioned inside passageway 20 while sheath 28 is hermetically sealed, as by silver brazing, or welding or soldering, at points 36 to rear end 22 of plug 12. Sheath 28 and core 30 are removed from the front end of wires 32 to allow them to extend exposed forward from plug 12. Passageways 20 are spaced symmetrically around a common center (FIG. 2).

Front end 24 of plug 12 has a stepped down portion 38 received in and abutting an annular rim 40 in the rear end 42 of female receptacle 14. Rim 40 is hermetically sealed, as by welding, soldering or brazing to plug 12 at points 44, as shown in FIGS. 1 and 2. Receptacle 14 preferably is generally cylindrical and of stainless steel or other corrosion resistant metal. Rim 40 defines a rear central space 46 communicating with a central passageway 48 extending longitudinally through receptacle 14 to the front end 50 thereof.

Passageway 48 receives a single electrical conduit 52 which may comprise an outer metallic sheath 54 and a dielectric core 56 bearing spaced electrically conductive wires 58 corresponding in number to the total number of wires 32 in all of conduits 26, in this instance ten wires 58. Sheath 54 is hermetically sealed, as by brazing, welding or soldering, to receptacle 14 at points 60 at end 50 (FIG. 1). Conduit 52 is peeled of sheath 54 and core 56 at its rear end 62 to expose wires 58.

Preferably, dielectric spacer 18 is of, for example, glass, ceramic or a high temperature plastic such as nylon, polytetrafluoroethylene or the like, and has wire guiding passageways 66 extending longitudinally therethrough. Spacer 18 is disposed in passageway 48 behind conduit 52 and receives wires 58, guiding them into central space 46 and into contact with novel dielectric wire spreader 16.

Spreader 16 can be formed of dielectric material similar to that described for spacer 18. The front end 70 of spreader 16 abuts spacer 18, while the rear end 72 of spreader 16 abuts plug 12 (FIG. 1). Preferably, the front portion 74 of spreader 16 is generally frusto-conical, narrowing toward front end 70, and bearing a plurality of spaced grooves 76 in the outer surface thereof, in which wires 58 are disposed to isolate them from each other, to fan them out and to guide them toward wires 32.

Wires 32 pass forwardly from conduits 26 and plug 12 through spaced passageways 80 in the rear portion 82 of spreader 16 and into connection with wires 58 in space 46. In FIG. 1, the ends of wires 32 and 58 are shown looped together and spot welded at points 84 for secure interconnection.

It will be noted that spreader 16 preferably has an intermediate narrow integral neck portion 86 which defines with portions 74 and 82 an annular recess 88 in which the ends of wires 32 and 58 are joihed together. Preferably, portions 82 and 86 are generally cylindrical, with portion 82 of greater diameter than portions 74 and 86.

Spreader 16 not only accurately guides wires 32 and 58 into proper alignment, but properly aligns and spaces, with spacer 18, the other components of device 10 and is wholly contained within hermetically sealed space 46 for full protection of wires 32 and 58 and conduits 26 and 52. It also acts, with spacer 18, as a shock-resistant cushioning component to prevent dislocation of components of device 10 under vibration conditions.

In assembling device 10 conduits 26 are installed in passageways 20 after removing a portion of sheath 28 and core 30, to expose wires 32 and to permit conduits 26 to fit into and abut passageways 20. Then wires 32 are passed forwardly through passageways 80 of spreader 16. Sheath 54 and core 56 are stripped to expose wires 58, after which conduit 52 is installed in passageway 48 with receptacle 14 retracted to expose spreader 16. Wires 58 are fed through passageways 66 in spacer 18 and placed in grooves 76, then welded or otherwise joined to wires 32 in recess 88, whereupon receptacle 14 and plug are fitted together, and hermetical sealing is effected at points 36, 44 and 60 to complete the desired assembly. Thus, device 10 is rapid and easy to install and effectively aligns and protects conduits 26 and 52 and their wires 32 and 58 from corrosion, high temperature degradation and the like.

Various modifications, changes, alterations and additions can be made in the improved connector device of the present invention, its components and their parameters. All such modifications, changes, alterations and additions as are within the scope of the appended claims form part of the present invention.

What is claimed is:

1. An improved, hermetically sealed, multiple conduit-to-single conduit connector device, said device comprising, in combination:

a. a male plug comprising a housing having a plurality of spaced, electrical conduit-receiving passageways extending longitudinally therethrough from the rear end to the front end thereof;

b. a female receptacle comprising a housing having an annular rim defining a central space within which the front end of said male plug is received and secured thereto, said female housing including a central longitudinal passageway extending therethrough, communicating with said central space and adapted to receive a single electrical conduit carrying a plurality of wires; and, c. a dielectric wire spreader disposed between said plug front end and said longitudinal passageway in said central space, said spreader including a rear male plug-abutting portion and a front wire guide portion connected thereto and having a sloped outer surface defining spaced wire-receiving grooves adapted to guide wires from multiple electrical conduits in said male plug passageways into contact with wires from an electrical conduit in said female receptacle passageway within said central space.

2. The improved connector device of claim 1 wherein said rear portion of said spreader includes multiple conduit wire guide passageways extending longitudinally therethrough.

3. The improved connector device of claim 2 wherein said front portion of said wire spreader is generally frusto-conical and is spaced from said rear spreader portion by a narrow neck portion.

4. The improved connector device of claim 3 wherein said front, neck and rear portions of said wire spreader are integral and wherein said wire spreader defines an annular space next to said neck for receiving the ends of and connections between said multiple conduit wires and single conduit wires.

5. The improved connector device of claim 4 wherein the rear portion of said wire spreader is cylindrical, wherein said male plug passageways are disposed in a circular array, and wherein said male plug housing and female receptacle housing are cylindrical.

6. The improved connector device of claim 5 wherein said device includes a cylindrical dielectric spacer having a plurality of single conduit wire passageways extending longitudinally therethrough, which is disposed between and abuts said female receptacle central passageway and said wire spreader.

7. The improved connector device of claim 6 wherein said female receptacle housing includes a necked down tubular end portion defining a portion of said central passageway.

8. The improved connector device of claim 7 wherein said front end of said male plug includes an annular rim having a front shoulder of reduced diameter received within said female receptacle rim.

9. The improved connector device of claim 8 wherein said device includes five two wire electical conduits hermetically sealed in said male plug passageways and disposed around a common center, wherein said female receptacle central passageway has a ten wire single conduit hermetically sealed therein and wherein said male plug is hermetically sealed to said female receptacle.

10. The improved connector device of claim 9 wherein said male plug and female receptacle comprise stainless steel and wherein said wire spreader and dielectric spacer comprise polytetrafluoroethylene.

* * * * *